US006695157B1

(12) United States Patent
Laenge

(10) Patent No.: US 6,695,157 B1
(45) Date of Patent: Feb. 24, 2004

(54) ROTARY CRANE

(75) Inventor: Walter Laenge, Ludesch (AT)

(73) Assignee: Liebherr-Werk Nenzing GmbH, Nenzing (AU)

( * ) Notice: Subject to any disclaimer, the term of this patent is extended or adjusted under 35 U.S.C. 154(b) by 0 days.

(21) Appl. No.: 09/855,258

(22) Filed: May 15, 2001

(51) Int. Cl.[7] ..... B66C 23/86; B66C 23/84
(52) U.S. Cl. ..... 212/247; 212/253
(58) Field of Search ..... 212/247, 253, 212/181

(56) References Cited

U.S. PATENT DOCUMENTS 2,627,954 A * 2/1953 Senn et al.
3,807,250 A * 4/1974 Dietzel et al. ..... 74/410
3,917,074 A * 11/1975 Havard et al. ..... 212/276
4,013,174 A * 3/1977 Morrow, Sr. et al. ..... 212/68
4,044,902 A * 8/1977 Eitel ..... 212/247
4,295,560 A * 10/1981 Cross ..... 198/517
4,513,869 A * 4/1985 Goudy ..... 212/247
4,688,983 A * 8/1987 Lindbom ..... 414/735
5,310,067 A 5/1994 Morrow
5,328,040 A 7/1994 Morrow
5,746,148 A * 5/1998 Delago ..... 114/230
6,035,736 A * 3/2000 Gyllner et al. ..... 212/247

* cited by examiner

*Primary Examiner*—Thomas J. Brahan
(74) *Attorney, Agent, or Firm*—Dilworth & Barrese LLP

(57) ABSTRACT

The foregoing invention concerns a rotary crane, especially an offshore crane of the king post type. The rotary crane has a pylon that can be permanently anchored on a floor plate, platform, or similar equipment, a turntable mounted to revolve on the longitudinal axis of the pylon, and rotating gear for rotating the turntable on the pylon, the rotating gear having a ring gear positioned on the pylon and a pinion drive that is connected with the turntable and meshes with the ring gear. According to the invention, the pinion drive is mounted on the turntable so that it can move radially relative to the ring gear, and is linked with the ring gear by means of coupling equipment. Tipping movements of the turntable relative to the pylon as a consequence of support clearance can thereby be equalized, and damage to the rotating gear can be prevented. Preferably the ring gear is multi-sectional and consists of several toothed segments attached to the pylon in such manner that they can be detached.

20 Claims, 6 Drawing Sheets

ROTARY CRANE

BACKGROUND OF THE INVENTION

Figure 1:
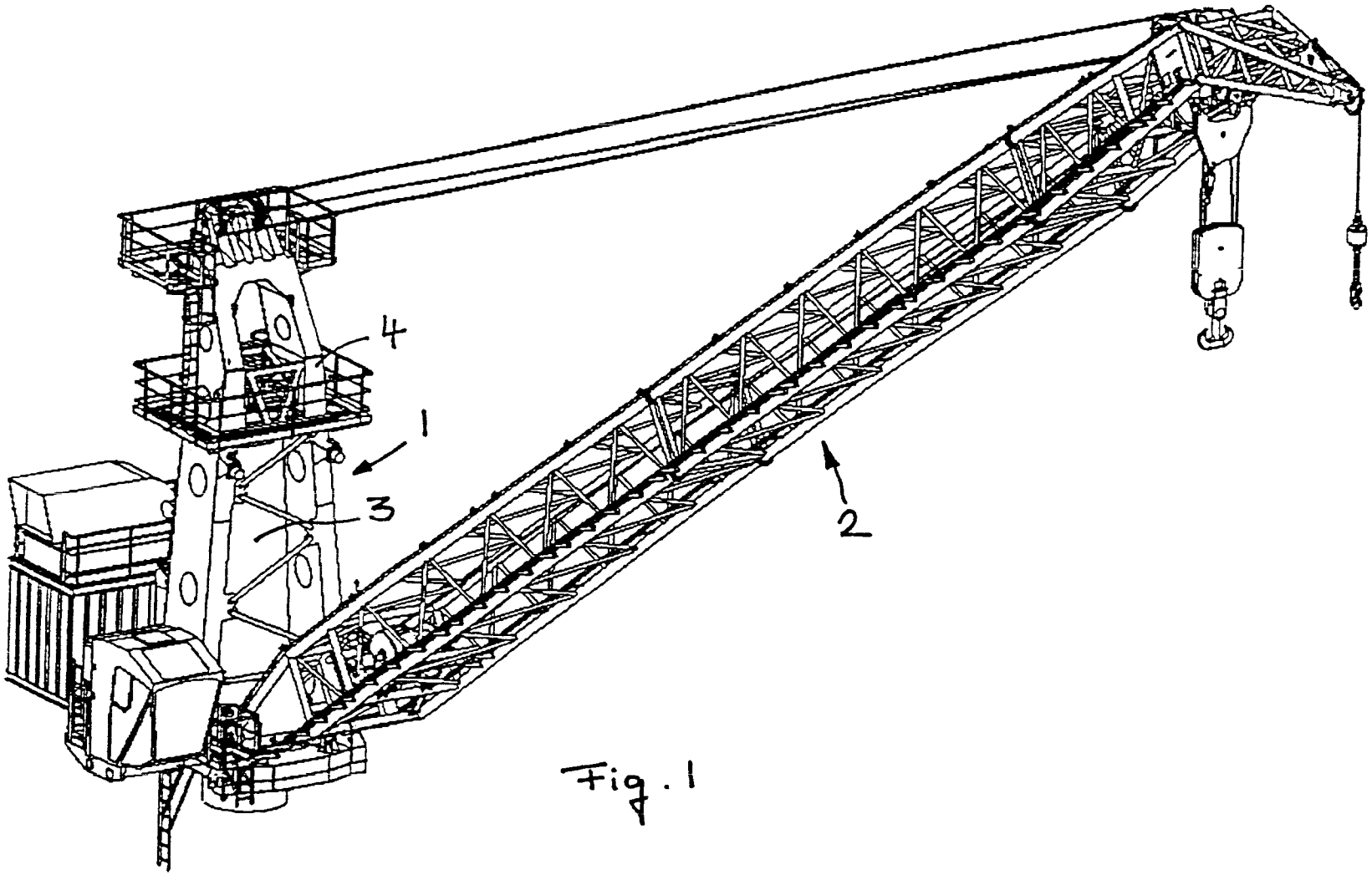

The present invention concerns a rotary crane, especially an offshore crane of the king post type with a pylon that can be permanently anchored to a base plate, platform, etc., a turntable mounted to revolve on the longitudinal axis of the pylon, a crane boom borne by the turntable and rotating gear for rotating the turntable on the pylon, where the upper support of the turntable includes a mount seated on an upper section of the pylon in such a manner that it can be rotated, which upper support has an axial support surface to brace axially against the pylon as well as a radial support surface to brace radially against the pylon and suspension means to suspend the turntable.

An offshore rotary crane of the king post type is known from, for example, U.S. Pat. No. 5,328,040 or U.S. Pat. No. 5,310,067. A boom that can luff on a horizontal axis is usually attached to the turntable, which boom can be pivoted by means of a supporting cable. Additionally, a lifting gear is usually positioned on the turntable or on the boom, which lifting gear has a lifting cable that runs over the peak of the boom for the purpose of lifting loads.

One problem with rotary cranes of this type concerns the rotating gear, with which the turntable together with the boom can be revolved on the pylon. As a consequence of play or distortions in the housing of the turntable on the pylon, for example as a result of wear or of manufacturing tolerances of the support, when loads are placed on the boom there may be tipping movements of the turntable with respect to the pylon. This can however cause damage to the rotating gear. In an extreme case, particularly when the bottom support of the turntable on the pylon is very worn, the corresponding forces are no longer absorbed by the support but rather by the rotating gear. The pinion drive is pressed too hard against the ring gear, so that the teeth of the ring gear or the drive pinion are damaged or the pinion shaft can break.

The present invention provides assistance here. The problem to be solved by the present invention is to create a rotary crane with an improved rotating gear that avoids the state-of-the-art disadvantages and further develops the state of the art in an advantageous manner.

SUMMARY OF THE INVENTION

According to the invention, this problem is solved by means of a rotary crane, especially an offshore crane, of the king post type, with a pylon that can be firmly anchored on a floor plate, platform, or the like, a turntable mounted to revolve around the pylon on its longitudinal axis, and rotating gear for rotating the turntable on the pylon, the rotating gear having a ring gear positioned on the pylon and a pinion drive that is connected with the turntable and which is in contact with the ring gear, the pinion drive being mounted on the turntable so that it can move radially relative to the ring gear, elastically forced against the ring gear. Preferred embodiments are described herein.

According to the invention, the rotating gear is designed in such manner that it can compensate for tipping movements of the turntable relative to the pylon caused by, for example, excessive support clearance. The pinion drive is mounted on the turntable in such manner as to move radially to the ring gear, so that when the turntable moves appropriately on the pylon the pinion drive yields and is not subjected to the corresponding forces. Advantageously the pinion drive is acted upon by restoring media that push the pinion drive back to the ring gear when the pinion drive is deflected, and force the pinion drive into its position in which it engages with the ring gear. The restoring media are supported appropriately on the turntable.

Especially, a spring device, preferably a compression spring, can be mounted on the turntable, which compression spring acts with restoring force on the ring gear. The spring device can be designed and positioned in such manner that in the starting position of the pinion drive the pinion drive is held in its starting position without initial tension, that is, the spring device exercises a force upon the pinion drive only when the pinion drive is pushed away from the pylon. Only when there is a torque transfer or a tipping movement of the turntable relative to the pylon, e.g. as a result of wear of the support, that is, when the drive pinion is pressed back, the spring becomes active and acts on the drive pinion with a spring power on the pylon. Appropriately, the restoring media are dimensioned in such manner that the pinion drive is always maintained in contact with the ring gear. The spring power exercised by the restoring media is preferably greater than the reaction power that occurs at the maximum drive torque of the pinion drive on the beveled tooth profile tending to push the pinion drive away from the ring gear. On the other hand, the restoring force is of course so small that upon appropriate movements by the turntable the pinion drive gives way in order to prevent its seizing or damage to it.

In principle, provision could be made to position only a portion of the drive pinion, especially the drive pinion meshing with the ring gear, movably on the turntable and to connect it with a drive motor by means of a drive element appropriate for permitting movement. Preferably, however, the pinion drive as a whole is mounted in such manner that it can move. The drive pinion meshing with the ring gear and the coordinated drive motor can form a unit that can move together in relation to the ring gear. According to a preferred embodiment of the invention, the drive pinion is positioned on a rocking arm that is mounted on a swivel axis on the turntable, which swivel axis is parallel to the longitudinal axis of the pylon. Preferably the swivel axis runs with its longitudinal axis essentially tangential to the perimeter direction of the pylon or the ring gear, so that the pinion drive mounted thereon swivels essentially radially away from the pylon and can be moved on the pylon when the rocking arm swivels on its swivel axis.

Preferably, for initial tension of the pinion drive, the spring device engages with the rocking arm and presses the rocking arm to the ring gear. The arrangement of pinion drive and spring device can theoretically vary. According to one embodiment of the invention, the pinion drive can be on one side and the contact point of the restoration medium can be on the other side of the swivel axis of the rocking arm. In this way an initial tension of the pinion drive against the ring gear can be created by means of a compression spring. According to one advantageous embodiment of the invention, however, the pinion drive and the contact point of the restoring medium are on the same side of the swivel axis. Especially, a compression spring can be caused to engage with the free end of the rocking arm, and the pinion drive can be positioned between the free end of the rocking arm and the rocking arm end that is mounted to swivel. This allows for a particularly compact design. In addition, a favorable mechanical advantage is achieved.

In a further development of the invention, the pinion drive is at a specified distance from the pylon or the ring gear. Advantageously, there is a support that is permanently connected with the pinion drive and which supports the pinion drive against its initial tension to the ring gear on the pylon. Appropriately the support tuns on a support surface different from the ring gear on the pylon.

In a further development of the invention, said support is on the rocking arm. The rocking arm is in continuous contact with the pylon. For example, the rocking arm can have a bearing surface that slides along the perimeter surface of the pylon. In a particularly preferred embodiment of the invention, on the free end of the rocking arm there is a support roller mounted to rotate on a rotary axis parallel to the swivel axis of the rocking arm. The initial tension of the spring device, whose working axis runs through the support roller, presses the support roller against the pylon so that the support roller can roll on its sleeve surface when the turntable is revolved relative to the pylon.

Theoretically, the pinion drive support can run directly on the top of the pylon. Preferably, however, a separate ring is attached to the pylon, which ring with its exterior perimeter surface forms the running surface for the support. On the one hand, this prevents the unavoidable wearing down of the running surface from leading to a weakening of the pylon. On the other hand, the ring can be manufactured from a suitable material independent of the material of the pylon. The ring can be metal and if necessary can be tempered. Even if the ring becomes worn, this does not lead to a weakening of the pylon.

In a further development of the invention, the rocking arm can have a passage recess in which the pinion drive rests and which is of such nature that there is a drive motor on one side of the rocking arm and a drive pinion connected with the drive motor on the opposite side of the rocking arm. The pinion is thus very close to the rocking arm, so that the engagement forces can exercise only limited tipping movements on the rocking arm. In an advantageous embodiment, the drive pinion, which engages with the ring gear, can be operated by means of a planetary gear of a rapidly turning hydraulic motor with low output torque.

In a further development of the invention, several pinion drives can be provided to engage with the ring gear positioned on the pylon. The pinion drives are distributed around the perimeter of the pylon.

In a preferred embodiment of the invention, the pinion drives are pressed back to the plane of symmetry of the rotary crane; they can be positioned in an acute-angle sector positioned centrally to the longitudinal center plane of the rotary crane, defined by the pylon and the boom of the crane. Preferably the pinion drives are on the front of the turntable, that is, on the side facing the boom.

Preferably the ring gear is also built separate from the pylon and is bolted to the pylon. This considerably simplifies the manufacturing of the ring gear. On the pylon there can be a flange-shaped bridge on which the ring gear rests and to which it is bolted.

Figure 2:
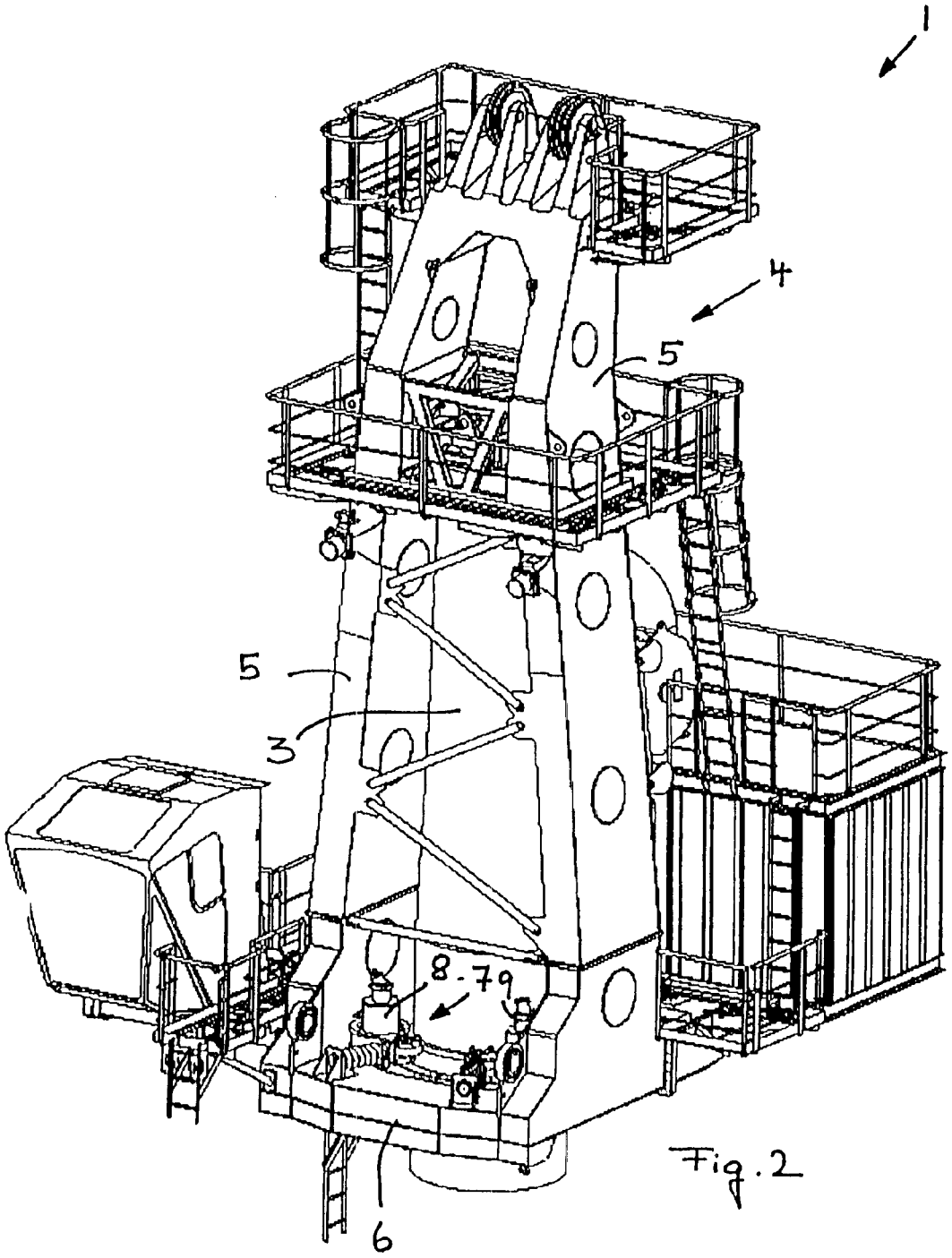
Figure 3:
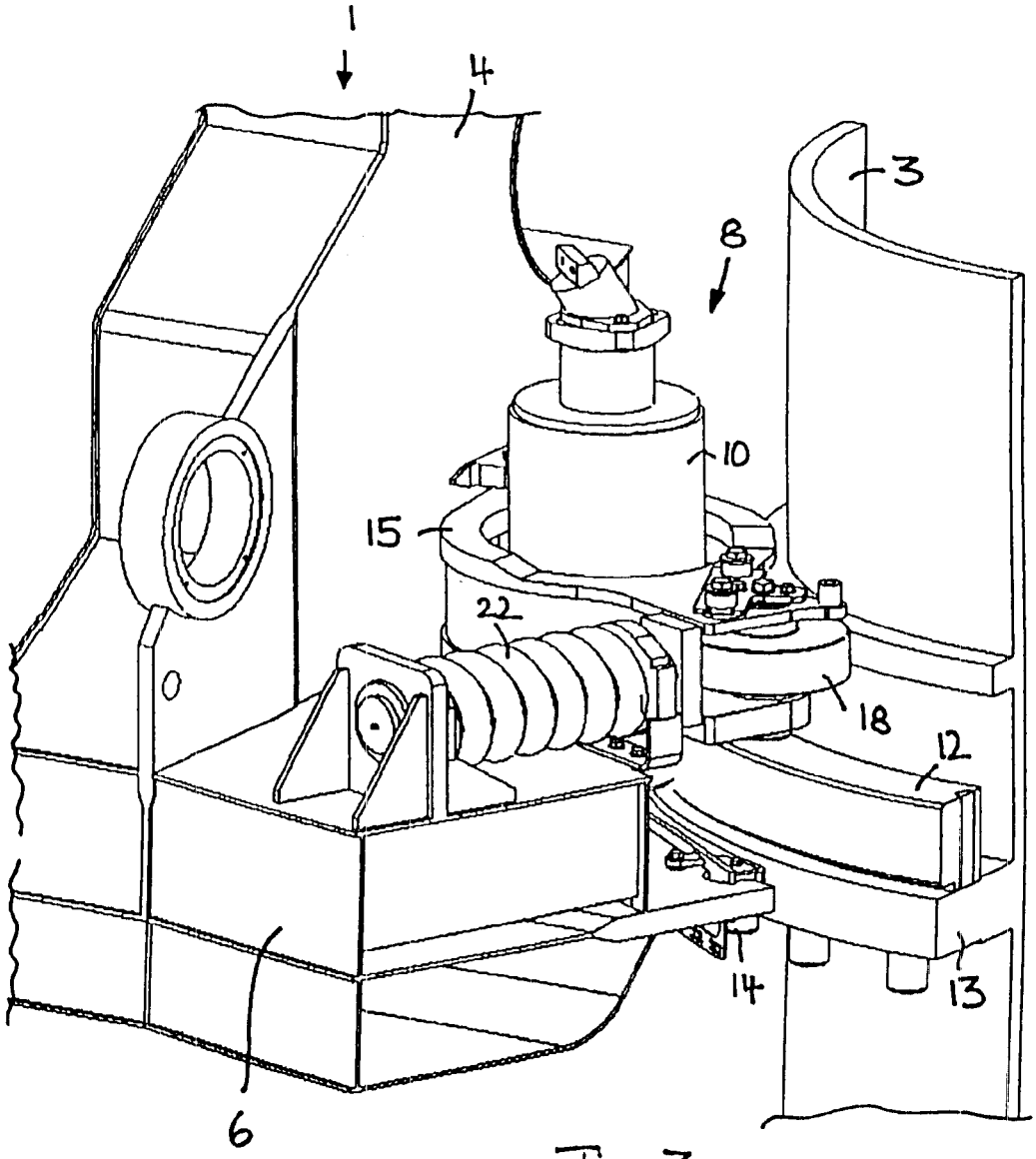
Figure 4:
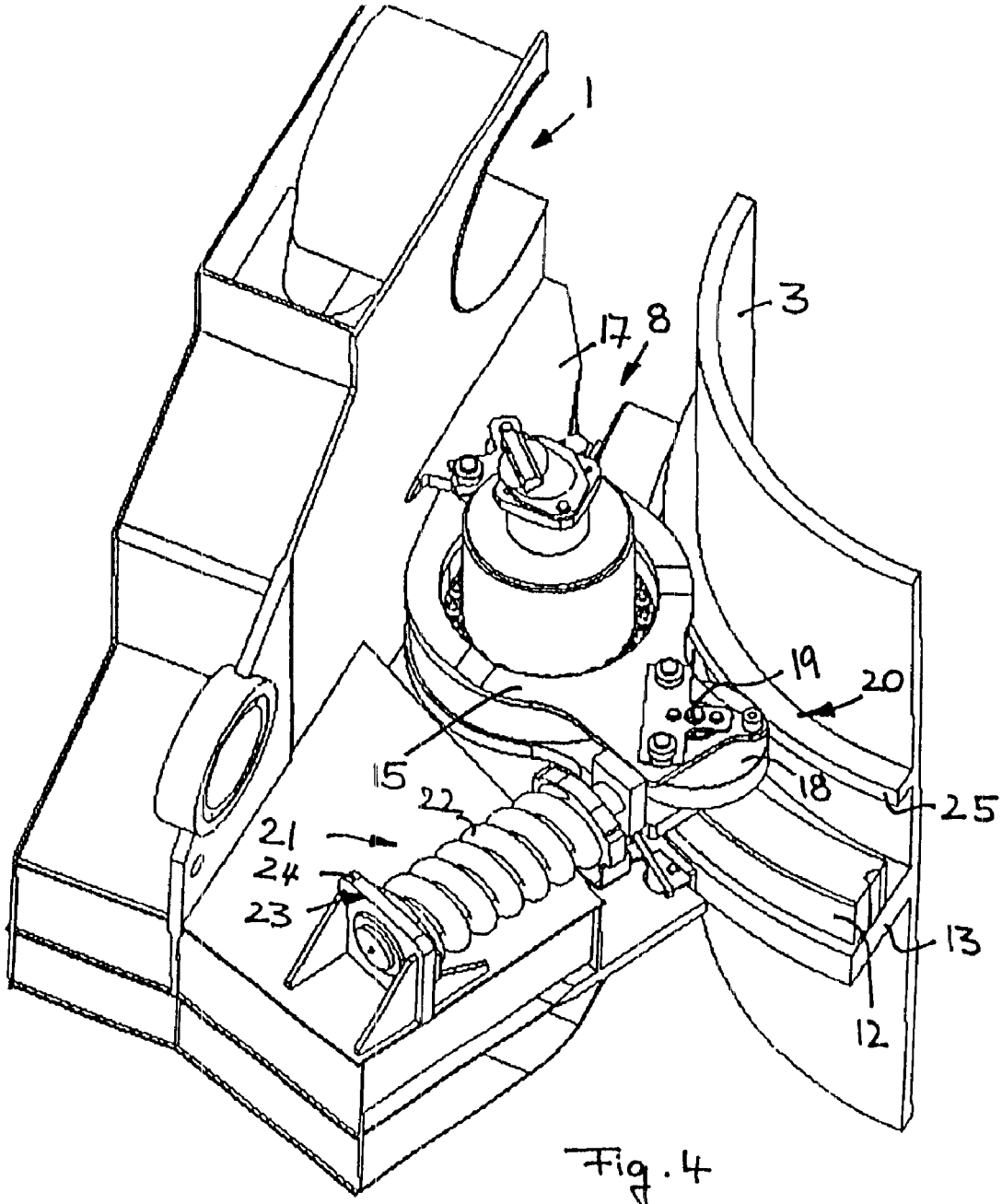
Figure 5:
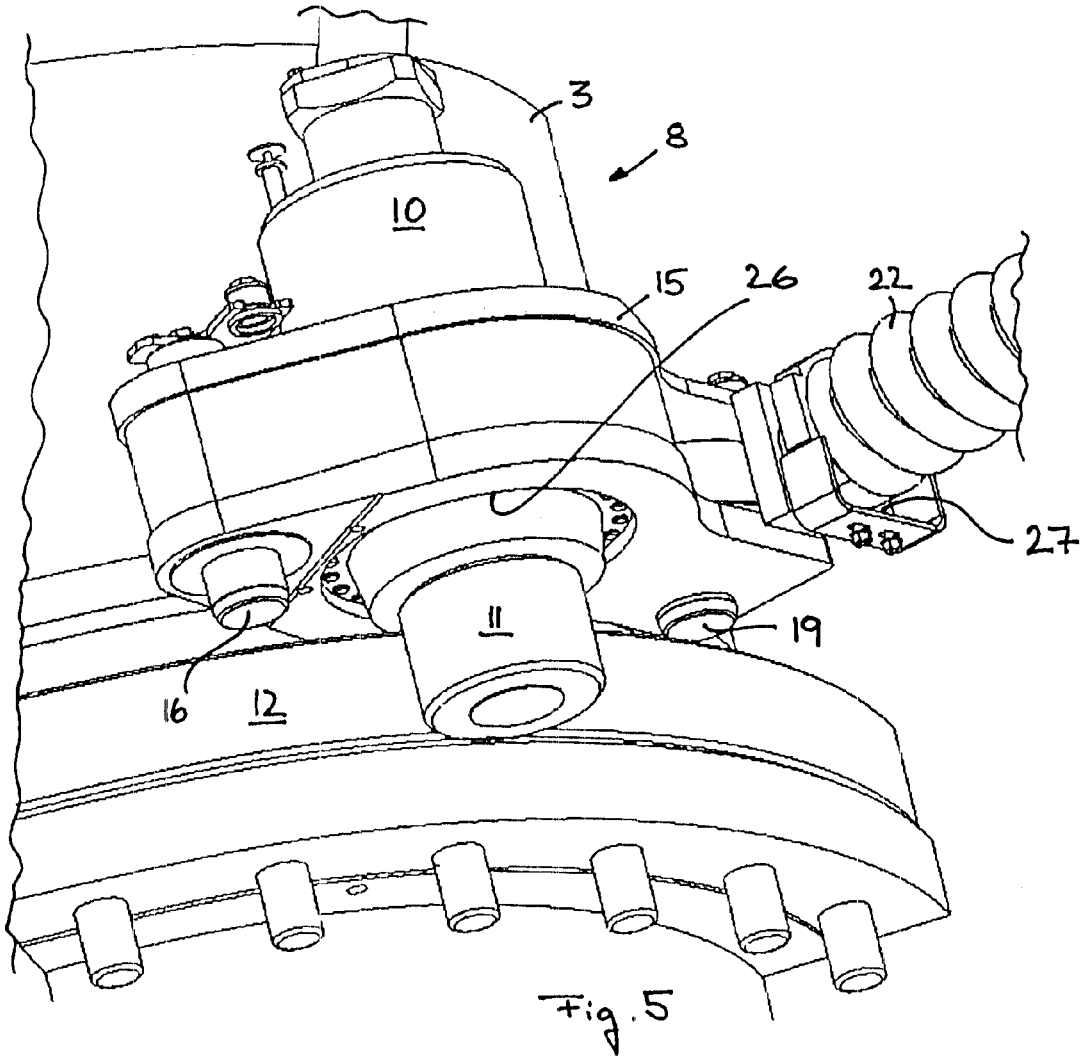
Figure 6:
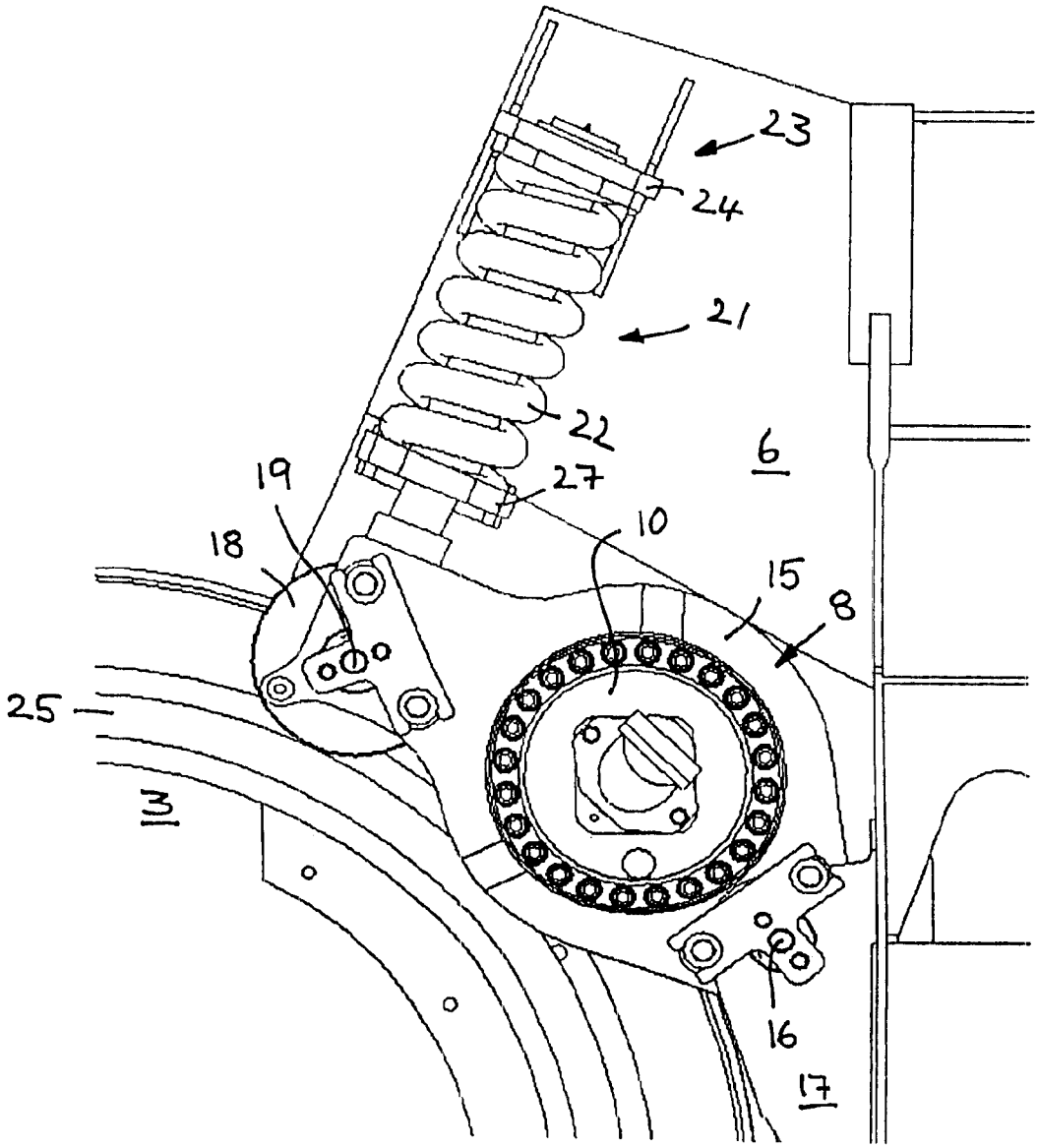

In a particularly favorable embodiment of the invention, the ring gear is not ring-shaped or in a single piece. Rather, there is a multi-section ring gear that consists of several separate toothed segments. Said toothed segments are preferably removably attached to the pylon; especially they can be bolted to the pylon. According to a preferred embodiment, the toothed segments are positioned on a flange-shaped bridge to which they are bolted axially. Such design of the ring gear has particular advantages. Especially, the toothed segments can be precision-worked and tempered. Since they are not subsequently welded, there is no distortion. The high degree of precision facilitates a harmonious engagement of the drive, and less wear and tear. In addition, the multi-section design of the ring gear and the detachable connection of the toothed segments to the pylon makes replacement much easier when wear occurs. In contrast to a one-piece ring gear, which could be removed from the pylon, if at all, only after disassembly of the turntable from the pylon; individual toothed segments can be unbolted with relatively greater ease for removal or replacement The present invention is described below in greater detail by means of a preferred embodiment and pertinent drawings showing:

FIG. 1 A perspective view of an offshore crane with a turntable mounted to revolve on a pylon, to which turntable a boom that can rotate around a horizontal axis is coupled, FIG. 2 a perspective view of the turntable of FIG. 1, without boom, which shows the arrangement of two rotating-gear pinion drives near the bottom support of the turntable on the pylon, FIG. 3 an enlarged sectional representation of the rotating-gear pinion drive positioned on the turntable, which meshes with a ring gear positioned on the pylon, FIG. 4 a perspective view from above of the rotating-gear pinion, drive similar to FIG. 3, showing the arrangement of a swiveling rocking arm on which the pinion drive rests, and its initial tensioning by means of a compression spring, FIG. 5 a perspective, partial section view from an oblique point under the pinion drive illustrated in the preceding figures, showing the arrangement of a drive pinion under the rocking arm and its engagement with the ring gear on the pylon, and FIG. 6 a top view of the rotating-gear pinion drive illustrated in the preceding figures.

The offshore crane shown in FIG. 1 has a turntable 1 with, at its lower end, a boom 2 mounted to swivel on a horizontal axis. Boom 2 is stayed by means of support cables that run above the top of turntable 1 to the free end of boom 2.

On the side of turntable 1 there is also a crane operator cab. On the back, facing boom 2, there are additional structures such as gears, counterweights, etc., arranged in a known manner.

Turntable 1 itself is mounted in such manner that it can revolve on the vertical longitudinal axis of a pylon 3 that is itself vertical. Pylon 3 is rigidly anchored to an appropriate support substructure. This can be, for example, the platform of an oil-drilling rig, a base plate, or the like.

As shown in FIG. 2, turntable 1 includes a support frame 4, essentially vertical along the pylon and resting on pylon 3. Support frame 4 consists essentially of two lateral pillars 5 joined by means of a yoke at the top of support frame 4 and additionally braced by means of cross-braces. Support frame 4 has a support ring at each of its bottom and top ends, which support rings encircle pylon 3 and are mounted to rotate on said pylon 3. The bottom support ring is indicated by reference number 6.

In the area of bottom support ring 6 there is rotating gear 7 with the help of which turntable 1 can be revolved on pylon 3. As shown in FIG. 2, rotating gear 7 has two pinion drives 8 and 9, positioned on the side of turntable 1 which faces boom 2. They rest on bottom support ring 6. Both rotating gears 7 move toward the longitudinal center plane between boom 2 and tower 4 (cf. FIG. 2).

As shown in FIG. 5, each of pirion drives 8 and 9 has a drive motor 10, which can be designed as a hydraulic motor, as well as a drive pinion 11, which is connected with the drive shaft of drive motor 10. As can be seen in FIG. 5, drive motor 10 and drive pinion 11 form an essentially rod-shaped longitudinal unit. Drive pinion 11 meshes with toothed segments 12, which extend along the perimeter of pylon 3 and are rigidly connected with said pylon 3. As shown in FIGS. 3 and 5, toothed segments 12 are permanently bolted by means of a number of studs to a flange 13 extending radially away from pylon 1. As shown in FIG. 3, toothed segments 12 rest on top of flange 13 on which the bottom support ring 6 of support frame 4 is mounted radially by means of support shoes 14.

Each of pinion drives 8 and 9 rests on a rocking arm 15 that is coupled to turntable 1 support frame 4 so that it can swivel. As shown in FIGS. 4 and 6, one end of rocking arm 15 is mounted on a swiveling axis 16 that runs parallel to the longitudinal axis of pylon 3. As shown in FIG. 4, rocking arm 15 rests between two flange plates 17, to which rocking arm 15 is bolted, so that rocking arm 15 can rotate appropriately. Flange plates 17 are attached rigidly to support frame 4 or support ring 6.

At the free end of rocking arm 15 there is a stabilizing wheel 18, mounted on rocking arm 15 and rotating on a rotary axis 19 parallel to the swivel axis 16 of rocking arm 15. The stabilizing wheel 18 forms a support 20, which holds or guides rocking arm 15 at a specified distance from the pylon 3. As shown in FIGS. 3 and 4, the rocking arm 15 is connected with the pylon 3 by means of spring device 21, depicted in the illustrated embodiment as a compression spring. The compression spring 22 is supported on the one side against an abutment 23, composed of a stop 24 rigidly connected with a support ring 6. At its other end, the compression spring 22 has a contact point on the free end of rocking arm 15. As shown in FIG. 5, compression spring 22 rests in a pan-shaped holder 27 positioned rigidly at the free end of the rocking arm. The working axis of spring device 21 passes through the rotary axis of stabilizing wheel 18, so that this wheel directly receives the initial tension of spring device 21. As a result of the spring force of spring device 21, rocking arm 15 with its attached stabilizing wheel 18 always runs down pylon 3. The running surface on which stabilizing wheel 18 runs is constructed as a raceway 25 radiating from pylon 3 (cf. FIG. 4) and rigidly attached to the outer periphery of pylon 3.

The pinion drive 8 (cf. FIG. 5) rests between the free end of rocking arm 15 and swiveling axle 16. Rocking arm 15 has recess 26 through which the pinion drive 8 enters. Drive motor 10 rests on top of rocking arm 15, while drive pinion 11 moves directly out of recess 26 on the underside of rocking arm 15. Pinion drive 8 is attached rigidly to rocking arm 15 by means of appropriate attachment devices.

As shown in FIG. 5, drive pinion 11, which can rotate on an axis parallel to the longitudinal axis of pylon 3, can mesh with the teeth on the outer periphery of ring gear 12. Due to the swivel arrangement, pinion drive 8 or 9 can compensate for tipping movements of turntable 1 relative to pylon 3. For example, given an appropriate support clearance, if as a consequence of forces exerted by boom 2 the bottom end of support frame 4, i.e. its side facing boom 2, is pressed back against pylon 3, the flexible suspension of rotating gear 7 yields. Pinion drives 8 and 9 are pushed away against the initial tension of spring device 21. Rocking arm 15 rotates counterclockwise on swivel axle 16, as shown in FIG. 6.

What is claimed is:

1. Rotary king post crane having a vertical central pylon structured and arranged to be firmly anchored on a floor plate or floor, a turntable supporting a boom and being mounted on said pylon to revolve around the pylon by an upper bearing positioned at an upper end of the pylon, and a lower bearing spaced apart from the upper bearing, a rotating gear for rotating the turntable on the pylon, the rotating gear having a ring gear fixed to an outer circumferential surface of the pylon in a region of the lower bearing, said ring gear having external teeth, and a pinion drive structured and arranged to be connected with the turntable and in contact with the ring gear, and the pinion drive being mounted on a rocking arm coupled to the turntable to move radially relative to the turntable and ring gear and be elastically forced inwardly against the external teeth of the ring gear by a spring device.

2. Rotary crane according to claim 1, in which the dimensions of the spring device are such that the restoring force exerted by the spring device is greater than the force that at maximum drive torque of the pinion drive pushes the pinion drive away from the ring gear and which results from the meshing of pinion drive and ring gear.

3. Rotary crane according to claim 2, having a support that is firmly connected to the pinion drive and which supports the pinion drive by tension against the ring gear on the pylon on a support surface that is separate from the ring gear.

4. Rotary crane according to claim 2, in which the rocking arm is able to swivel on a swivel axis that is essentially parallel to the longitudinal axis of the pylon.

5. Rotary crane according to claim 4, having a support that is firmly connected to the pinion drive and which supports the pinion drive by tension against the ring gear on the pylon on a support surface that is separate from the ring gear.

6. Rotary crane according to claim 4, in which the rocking arm has a spring force contact point and the pinion drive rests between the spring force contact point and the swivel axle of the rocking arm.

7. Rotary crane according to claim 1, having a support that is firmly connected to the pinion drive and which supports the pinion drive by tension against the ring gear on the pylon on a support surface that is separate from the ring gear.

8. Rotary crane according to claim 7, in which a spacer ring is positioned on the pylon and forms the running surface for the support.

9. Rotary crane according to claim 1, in which a support roller is mounted on a rotary axle and can rotate on a rotational axis parallel to the longitudinal axis of the pylon.

10. Rotary crane according to claim 9, in which a spacer ring is positioned on the pylon and forms the running surface for the support.

11. Rotary crane according to claim 1, in which the rocking arm has a through recess in which the pinion drive rests, in such manner that a drive motor lies on one side of the rocking arm and a drive pinion lies on a second side of the rocking arm opposite the first side.

12. Rotary crane according to claim 1, in which the boom is coupled to the turntable and together with the pylon defines a longitudinal center plane of the rotary crane and the pinion drive is positioned along the periphery of the pylon in the area of the longitudinal center plane.

13. Rotary crane according to claim 1, in which the pinion drive is positioned on the boom side of the turntable.

14. Rotary crane according to claim 1, in which multiple pinion drives are provided.

15. Rotary crane according to claim 1, in which the ring gear is structured and arranged to be rigidly connected with the pylon, preferably by being bolted to it.

16. Rotary crane according to claim 1, in which the ring gear is multi-sectional and consists of multiple toothed segments attached to the pylon in such manner that they can be detached.

17. Rotary crane according to claim 1, in which the rocking arm is able to swivel on a swivel axis that is essentially parallel to the longitudinal axis of the pylon.

18. Rotary crane according to claim 1, in which the spring device includes a compression spring.

19. Rotary crane according to claim 1, additionally comprising the rocking arm rotatably coupled to the pinion drive about a swivel axis, and a roller rotatably mounted upon the rocking arm about a rotary axis substantially parallel to the swivel axis and to continuously contact the pylon, hold and guide the rocking arm at a distance from the pylon, with said spring positioned rigidly at a free end of the rocking arm and arranged with a working axis thereof passing through the rotary axis of the roller which is biased thereby, such that when the boom exerts force against the support frame, the flexible suspension of the rotating gear yields with the pinion drive pushing away against the biasing means, and, at the same time, with the rocking arm rotating upon the swivel axis thereof to maintain contact of the roller with the pylon.

20. Rotary crane according to claim 1, wherein the pinion drive (11) is acted upon by restoring force of the spring device (22) to push the pinion drive (11) back to the ring gear (12) when the pinion drive (11) is deflected and force the pinion drive (11) into engagement with the ring gear (12), said spring device (22) being supported upon the turntable (1).

* * * * *